US005430960A

United States Patent [19]

Richardson

[11] Patent Number: 5,430,960

[45] Date of Patent: Jul. 11, 1995

[54] LIGHTWEIGHT ATHLETIC SHOE WITH FOOT AND ANKLE SUPPORT SYSTEMS

[76] Inventor: Willie C. Richardson, P.O. Box 1801, Cullowhee, N.C. 28723

[21] Appl. No.: 140,496

[22] Filed: Oct. 25, 1993

[51] Int. Cl.[6] ..... A43B 7/14; A43B 19/00; A43B 7/20

[52] U.S. Cl. ..... 36/89; 36/88; 36/93; 36/44; 36/50.1; 36/114

[58] Field of Search ..... 36/44, 43, 89, 88, 93, 36/50.1, 54, 114, 153

[56] References Cited

U.S. PATENT DOCUMENTS

| | | | |
|---|---|---|---|
| 1,753,415 | 4/1930 | Hepburn | 36/54 |
| 2,145,102 | 1/1939 | Spini | 36/54 |
| 2,147,197 | 2/1939 | Glidden | 36/45 |
| 2,439,545 | 4/1948 | Matlas | 36/153 |
| 2,539,026 | 1/1951 | Mangold | 36/54 |
| 2,791,844 | 5/1957 | Horlacher | 36/153 |
| 3,543,765 | 12/1970 | Alzner . | |
| 3,613,273 | 3/1970 | Marquis . | |
| 4,053,995 | 10/1977 | Shein | 36/54 |
| 4,100,686 | 7/1978 | Sgarlato et al. | 36/44 |
| 4,215,492 | 8/1980 | Sandmeier . | |
| 4,219,945 | 9/1980 | Rudy | 36/44 |
| 4,571,856 | 2/1986 | Lin et al. . | |
| 4,575,954 | 3/1986 | Bye . | |
| 4,726,126 | 2/1988 | Bernard . | |
| 4,896,441 | 1/1990 | Galasso . | |
| 4,928,405 | 6/1986 | Spademan . | |
| 4,999,931 | 3/1991 | Vermeulen | 36/44 |
| 5,109,613 | 5/1992 | Van Dyke . | |
| 5,150,490 | 9/1992 | Busch et al. | 36/43 |
| 5,158,767 | 10/1992 | Cohen et al. . | |
| 5,175,947 | 1/1993 | Parracho . | |
| 5,203,793 | 4/1993 | Lyden . | |
| 5,317,820 | 6/1994 | Bell et al. | 36/89 |
| 5,343,638 | 9/1994 | Legassie et al. . | |

FOREIGN PATENT DOCUMENTS

| | | | |
|---|---|---|---|
| 1006263 | 4/1952 | France | 36/93 |
| 1055295 | 2/1954 | France | 36/93 |
| 26637 | of 1896 | United Kingdom | 36/54 |
| 946 | of 1899 | United Kingdom | 36/54 |
| 2263222 | 7/1993 | United Kingdom | 36/45 |

*Primary Examiner*—Steven N. Meyers
*Attorney, Agent, or Firm*—Sixbey, Friedman, Leedom & Ferguson

[57] ABSTRACT

A lightweight athletic shoe with an ankle support system and a foot comfort and support system is provided. The ankle support system, which includes an integral brace with removable ankle support elements, may be modified by the wearer to vary the amount of support provided as needed. The foot comfort and support system includes a composite insole with a spongy, moisture absorbing layer and an air layer with an air-filled arch support and an air-filled upper foot comfort cushion located around the shoelace-holding eyelets. Air-filled pockets in the shoe upper provide design elements and contribute to the reduction in the weight of the shoe.

15 Claims, 3 Drawing Sheets

LIGHTWEIGHT ATHLETIC SHOE WITH FOOT AND ANKLE SUPPORT SYSTEMS

TECHNICAL FIELD

The present invention relates generally to athletic shoes and particularly to an athletic shoe which is lightweight and provides enhanced comfort and support for the foot and ankle.

BACKGROUND OF THE INVENTION

Athletes, particularly professional athletes, who must play their sport at frequent intervals with little recovery time during the sport's active season require footwear that is comfortable, supports the feet properly and, ideally, is lightweight and easy to move in without fear of injury. Athletic footwear has become increasingly specialized so that shoes suitable for one sport are not necessarily the best footwear for another sport. For example, long distance runners have different foot support needs than basketball players who must often change directions quickly. In basketball and other sports where quick lateral movements and turns are required, the shoes must support the foot and ankle in a manner that provides adequate support for these structures, but does not, in the process, increase the likelihood of injury to other body parts, such as the knees. The prevention and avoidance of injury is especially important to professional athletes, who often must play several games in a relatively short period of time.

The prior art has proposed a large number of different kinds of shoe designs that are asserted to provide support to an athlete's feet. U.S. Pat. No. 3,613,273 to Marquis, for example, discloses a shoe intended to minimize ankle strain. This shoe design, however, includes only a single ankle supporting element located over the lateral malleolus and extending under the foot between the sole and the top of the shoe upper. Such an arrangement does not uniformly support the ankle structures against different kinds of injuries and would not enable a player with a weak ankle to continue to play.

U.S. Pat. No. 5,175,947 to Parracho discloses an athletic shoe with a removable ankle support in the form of a pair of Y-shaped sheet springs formed of a relatively unstretchable and incompressible sheet material and attached by straps. The upper edge of these ankle supports terminates below the ankle, which compromises the degree of support provided to the ankle structures. Moreover, the supports disclosed in this patent are fastened to the exterior of the shoe upper and could be knocked out of position or the connecting straps broken during athletic activity, which would disable the support structure. The weight of this type of ankle support, moreover, adds to the bulk of the shoe and makes quick movements difficult.

U.S. Pat. No. 4,571,856 to Lin et al. discloses an athletic shoe with a permanent support member that extends a substantial distance above the ankle to provide extra support above the ankle. However, the support element, which is fastened in the front with an extension of the eyelets that close the shoe upper, terminates close to the shin. Consequently, this support design could cause a knee or other injury in the event of the kind of quick pivoting movement which is often required during a basketball game because the support structure is inflexible and does not "give". In addition, the wide ankle strap intended to provide additional support extends only around the front of the ankle and does not provide the support needed to protect the entire ankle. Further, this shoe design results in a bulky, heavy shoe that is difficult to move quickly in.

U.S. Pat. No. 5,109,613 to Van Dyke discloses a "high top" athletic shoe which appears superficially to provide the kind of ankle and foot support needed for basketball and other sports which require quick, often jerky movements. However, the shoe design described and shown in this patent produces a shoe that is heavier than desirable for quick movements and has more decoration than effective foot supporting structures. The inventor of the present invention, who has played professional basketball, has worn a pair of the shoes described in this patent and is personally aware of their limitations.

U.S. Pat. No. 5,158,767 to Cohen et al. discloses an athletic shoe with an inflatable bladder in the tongue to provide a secure fit to an individual user's foot. The inflatable portions of this shoe design, although they enhance the fit, do not provide the support desired in a shoe intended to provide maximum support and injury prevention when worn to play basketball or similar sports. In addition, the tongue of this shoe design is likely to slide off to one side and not stay in place.

U.S. Pat. No. 4,928,405 to Spademan discloses a sport shoe which is intended to eliminate the movement of the foot in the shoe by increasing the tightness of the fit as a function of the forward flex of the leg relative to the foot. The design might be suitable for some sports which do not require the quick jerking movements of the foot and leg characteristic of basketball. However, this design leaves the ankle unprotected and does not provide the kind of support needed to prevent injury.

In addition to providing safe, effective ankle support for sports that require sudden quick, jerking movements and changes of direction, an ideal athletic shoe should be comfortable to wear. The structure of the shoe insoles contribute a great deal to the comfort of the shoe. Ideally, an athletic shoe insole should provide the necessary cushioning and support for the arch without creating friction with the bottom of the foot. Moreover, the foot-contacting surface of an insole for an athletic shoe should stay as dry as possible, even at the height of play, to prevent athlete's foot.

The prior art has proposed a wide variety of shoe insoles to support and ventilate the foot. U.S. Pat. Nos. 3,543,765 to Alzmer, 4,215,492 to Sandmeier and 4,896,441 to Galasso are illustrative of such prior art. U.S. Pat. No. 3,543,765 discloses a molded arch support formed of firm, resilient plastic. This structure may provide support for the arches under many conditions; however, its rigidity provides diminished comfort for the athlete. In the event an athlete's arches fall during competition, the insole describe in this patent is likely to exacerbate the pain.

The insole of U.S. Pat. No. 4,215,492 provides some ventilation inside the shoe, but is not designed to support and cushion an athlete's feet during intense play or competition. The orthopedic inner sole of U.S. Pat. No. 4,896,441 provides an optimum weight distribution which enhances its comfort in a walking shoe. However, this design does not provide the comfort or support desired for an athletic shoe intended to be worn during intense activity.

The prior art, therefore, has failed to provide a comfortable, lightweight athletic shoe for basketball and sports in which frequent sudden jerking movements and rapid changes in the direction of movement are required during the course of play that fits well, provides ankle support that can be varied as needed and does not increase the likelihood of knee and other injuries, and minimizes the likelihood of athlete's foot, turf toe and other foot conditions common to athletes. A need exists for such an athletic shoe for professional athletes and others who spend long periods of time wearing athletic footwear.

SUMMARY OF THE INVENTION

It is a primary object of the present invention, therefore, to overcome the disadvantages of the prior art and to provide an athletic shoe which provides maximum foot and ankle support and comfort during intense play or competition.

It is another object of the present invention to provide an athletic shoe which is both lightweight and comfortable and protects the foot.

It is still another object of the present invention to provide an athletic shoe which incorporates an ankle support system that eliminates the need to tape or brace the ankles.

It is yet another object of the present invention to provide an athletic shoe with an ankle support system that can be easily modified by an individual wearer to provide the degree of support specifically needed.

It is a further object of the present invention to provide a lightweight athletic shoe with a foot and arch support system which prevents such foot problems as fallen arches, athlete's foot and turf toe.

It is still a further object of the present invention to provide a lightweight, comfortable athletic shoe suitable for wear by basketball players which provides the ankle support required for the player to pivot and change directions quickly without causing injury to the knees or other parts of the leg.

In accordance with the foregoing objects, the present invention provides an athletic shoe that is particularly suitable for sports like basketball, which involve quick changes of direction, sudden lateral movements and fast pivoting turns during intense play. The present athletic shoe is lightweight and comfortable and includes an ankle support system wherein the degree of ankle support can be varied according to individual needs and a foot support system which cushions and protects the top, bottom and sides of the foot and supports the arches to prevent them from falling. Insole means included in the foot support system are structured to eliminate friction and sliding of the foot within the shoe and moisture buildup, thereby substantially eliminating the likelihood of athlete's foot and other foot conditions.

Further objects and advantages will be apparent from the following description, claims and drawings.

DESCRIPTION OF THE PREFERRED EMBODIMENTS

Athletes, particularly those who participate in high intensity sports such as basketball which demand sudden turns and changes in direction, are constantly in search of athletic shoes that are lightweight and comfortable but also provide adequate foot and ankle support. There is currently available to both the professional and recreational athlete an almost bewildering array of different kinds of athletic footwear. None of the available athletic footwear, however, provides a lightweight shoe that is both comfortable and fully supports the ankle and foot in a manner which substantially minimizes the likelihood of injury.

Basketball players, like many other kinds of athletes, are at risk of injury to the ankles and knees. The risk of injury arises in basketball in part because of the speed at which the game is played. Quick pivots, sudden lateral movements and fast jumps all take their toll on the players' feet and ankles. The demanding schedules, particularly of professional basketball players, often require that an injured athlete whose injury has not completely healed participate in competition. Often players have injured a foot or ankle several times so that it is weak and must be taped to support it against further injury during competition play. Heretofore, an athletic shoe that provides adequate support for weak or recently injured ankles that eliminates an athlete's need to tape his or her ankles has not been available. Further, until the present invention, there has not been available an athletic shoe to prevent problems associated with falling arches and athlete's foot while also providing the support and comfort necessary for intense athletic activity.

The athletic shoe of the present invention is comfortable and lightweight and includes a foot support system and an ankle support system. The ankle support system can be modified by the wearer to vary the amount of support provided by the shoe. It is not necessary for the athlete to tape his ankle or wear a brace with the present athletic shoe because the ankle support system provides the degree of support needed to support ankles weakened by previous injuries.

Figure 1:
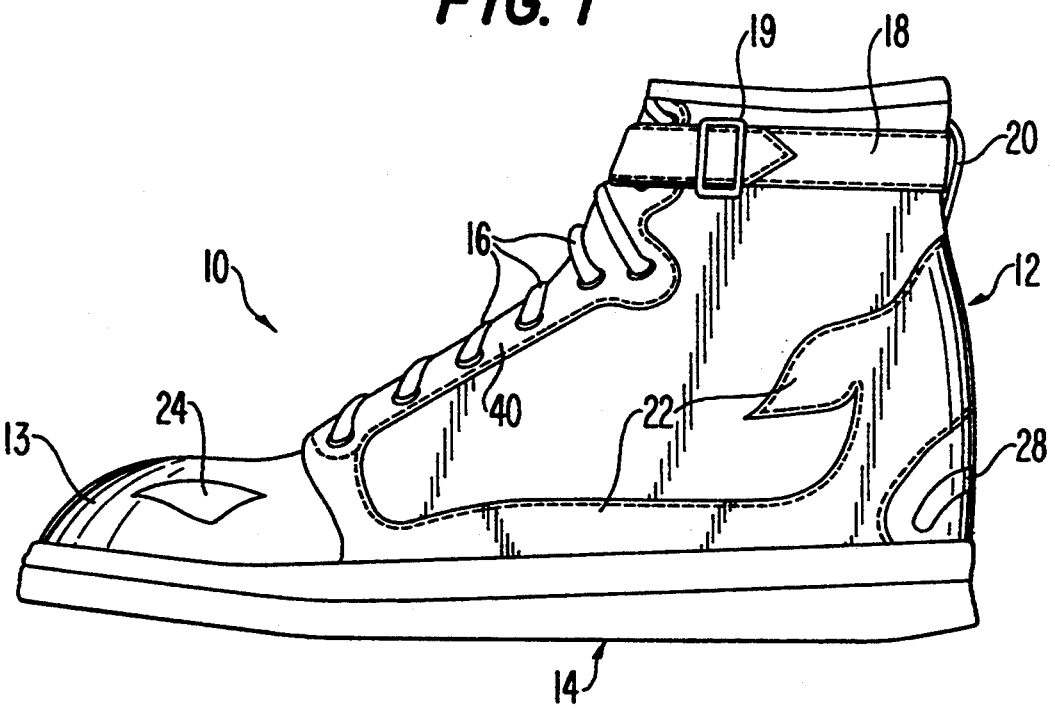
FIG. 1 is a side view of the exterior of an athletic shoe according to the present invention.

The foot and ankle support systems of the present invention can be best understood with reference to the drawings. FIG. 1 shows the exterior of this lightweight athletic shoe in side view. The shoe 10 has an upper 12 with a toe section 13 and an outer sole 14. The upper is fastened around the wearer's foot by laces 16 and a removable ankle strap 18, which has an additional purpose to be explained below. A loop 20 at the back of the shoe holds the strap 18 in place and allows easy removal when it is not used. The material of the upper 12 can be any of the materials customarily used for athletic shoes, including, but not limited to, natural and/or synthetic leather and nylon or similar synthetic fabrics. Trim and design elements 22 on the upper 12 may be formed of a contrasting material, such as sueded leather. If the shoe is to be used for basketball, the sole 14 should preferably be formed from a flexible material, such as natural or synthetic rubber, to provide both the spring needed by the wearer to leap and the cushion needed to land comfortably. If the shoe is to be used for other specific sports or for cross-training, an outer sole material and design appropriate for that activity can be used in connection with the shoe design of the present invention.

One of the objects of this shoe design is to provide an athletic shoe for a high intensity sport like basketball that is light in weight. To assist in achieving that objective the materials selected for the shoe upper 12 and outer sole 14 should be as lightweight as possible without sacrificing strength and durability. The shoe upper also includes air pockets which reduce the weight of the shoe. A pair of air pockets 24 and 26 in the toe section also reduce the weight of the shoe. These air pockets may have a decorative shape as shown to add a design element and may also be covered with clear plastic for further design interest. Alternatively, the air pockets 24 and 26 could be covered with the same material as the trim 22 or upper 12. A third weight reducing air pocket 28 is located at the back of the shoe where the wearer's heel would be.

Figure 2:
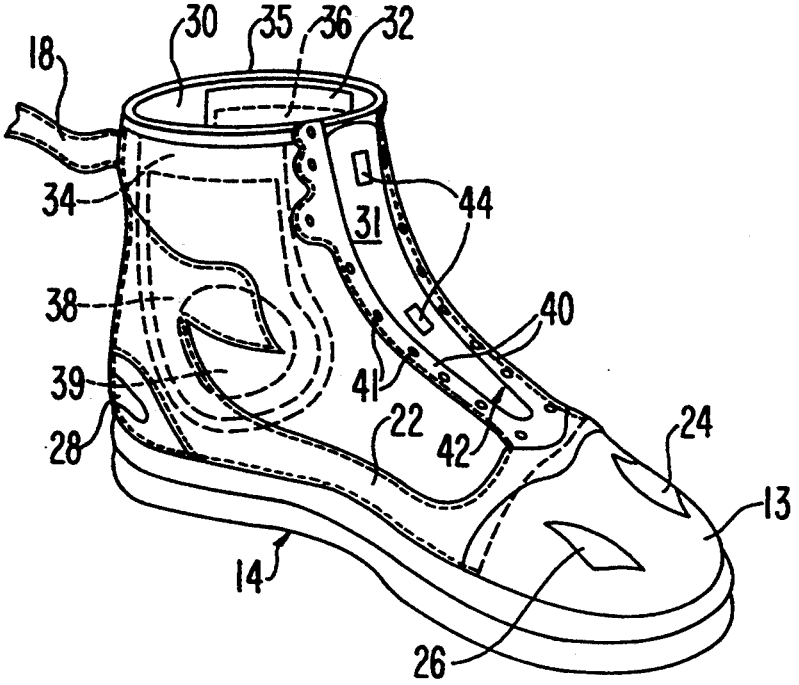
FIG. 2 is a side perspective view of an athletic shoe according to the present invention showing a portion of the ankle support system.

The shoe design of the present invention includes an ankle support system and a foot comfort and support system. The ankle support system includes several components which interact to provide a greater or lesser amount of support to the wearer's ankles. FIG. 2 illustrates these components. A sock-like brace 30 which substantially covers the wearer's foot is provided. The brace 30 is held in place by attachment to the tongue 31 of the shoe. Because the brace 30 covers the wearer's heel, excellent support is provided to the ankle by the brace alone. The brace 30 includes a pair of pockets 32 and 34 which are positioned on the brace so that when the wearer's foot is in the brace, the pockets cover the lateral malleolus and the medial malleolus (ankle bones) and the area surrounding them. Each of a pair of ankle support inserts 36 and 38 is inserted into one of the pockets 32 and 34. The inserts 36 and 38 are configured to conform generally to the medial or lateral shape of the area of the ankle to be supported. A cut-out area, such as cut-out 39, in support insert 38 is shaped to allow the malleolus to protrude through the opening so that the ankle support insert supports the ankle without causing discomfort to the ankle bone. The ankle support inserts are contoured to fit the left side and the fight side of each ankle.

The ankle support inserts 36 and 38 are held in the optimum position to support the ankle and prevent twisting or breaking by the pockets 32 and 34 in the brace 30. The strap 18 on the outside of the shoe is positioned to wrap around the shoe above the ankle support inserts so that the inserts cannot slide up out of the pockets. The strap 18 also keeps the brace 30 snug around the wearer's leg just above the ankle, which provides additional support. The strap 18 is preferably fastened with a buckle closure 19 or a snap button type of closure (not shown). This arrangement provides better support for the ankle than the VELCRO® fasteners often used on athletic shoes.

The brace 30 is preferably formed of a lightweight material that will support the foot without excessive "give". Leather, leather-like synthetics and similar materials are especially suitable for this purpose. The ankle support inserts 36 and 38 are preferably made from a flexible plastic material that will not cause discomfort to the wearer, but will provide the ankle support required.

The degree of support provided by the athletic shoe ankle support system of the present invention can be varied as needed by the wearer. For maximum support, the ankle support inserts 36 and 38 are inserted into the pockets 32 and 34 of the brace 30. The wearer places his foot first in the brace and then into the shoe 10. The laces 16 are adjusted and tied, and the ankle strap 18 is fastened securely yet comfortably. For minimum support, the ankle support inserts 36 and 38 are removed from the pockets 32 and 34 of the brace 30. The wearer then places his foot in the brace 30 and the shoe 10 and tightens the laces 16 to the desired degree of tightness and support. The strap 18 is removed from the loop 22 and not used. For additional support between the minimum and maximum, the strap 18 can be buckled or fastened in place without the ankle support inserts. Further, the supports can be used in only one shoe, if desired.

In addition to providing an ankle support system with excellent ankle support for players with weak or previously injured ankles so that the ankle taping and bracing required with available shoe designs is now no longer necessary, the athletic shoe of the present invention provides a foot comfort and support system which makes this shoe comfortable for playing even very high intensity sports. One common source of discomfort in many types of athletic shoes is the area around the eyelets through which the laces are threaded. In the present athletic shoe, the eyelets 41 are located in an air-filled strip 40 which extends around both sides and the bottom edge of the opening 42 in the upper 12. When the laces of an athletic shoe are laced as tightly as many athletes lace them, the eyelets often leave imprints or red marks on the top of the foot. The inflation of the strip 40 with air provides comfortable, glove-like support to the upper part of the foot, even when the laces are fastened tightly.

Figure 3:
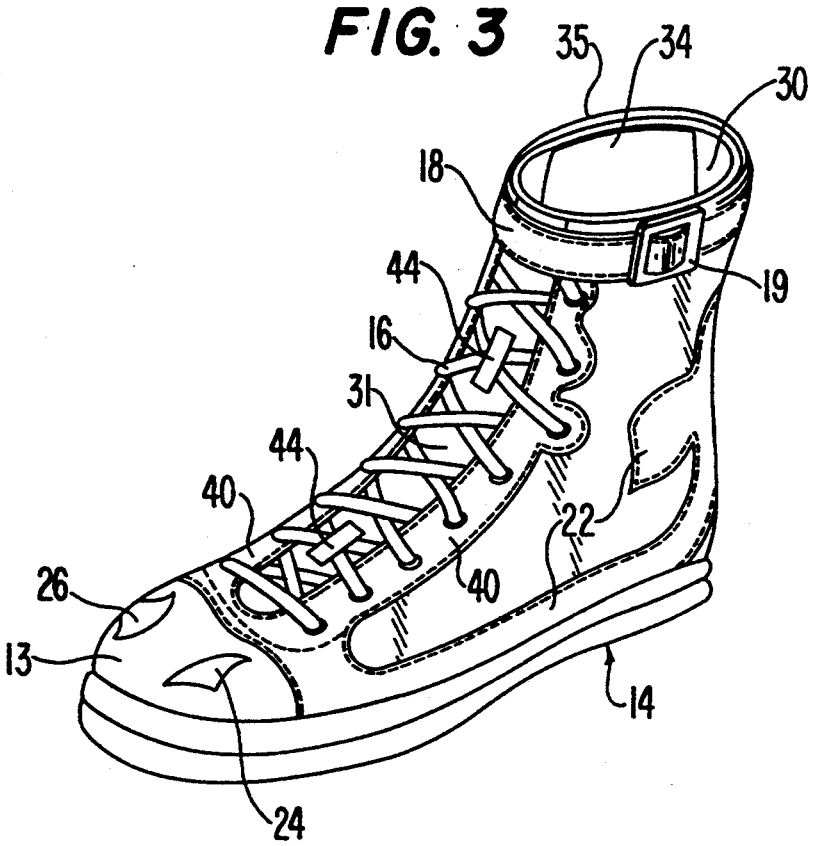
FIG. 3 is a perspective view of an athletic shoe according to the present invention showing a portion of the foot comfort and support system.

Another source of upper foot discomfort is the tongue of many athletic shoes, which tends to slip from its optimum center position. If the tongue slides to one side or toward the toe of the shoe, the shoe can become very uncomfortable. To avoid this likelihood, lace loops 44 are provided to hold the laces in place as shown in FIG. 3.

Figure 4:
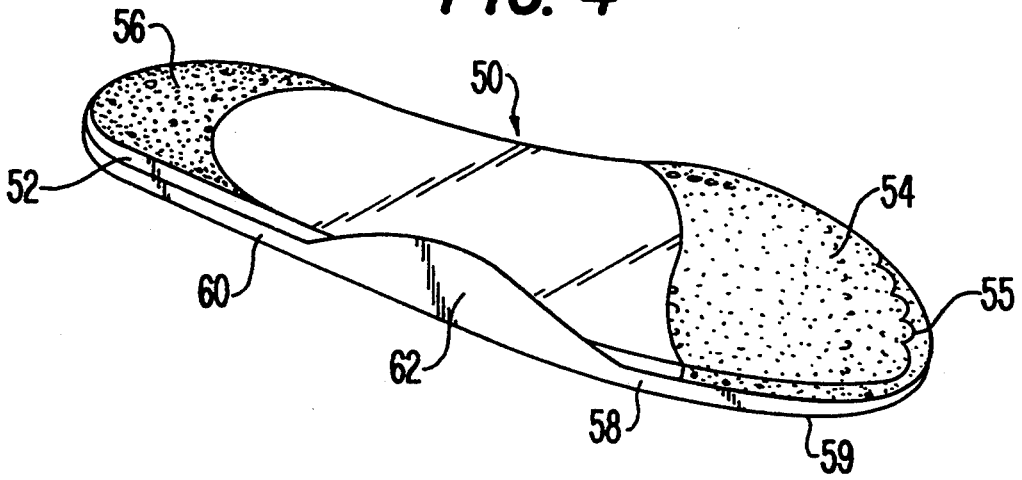
FIG. 4 is a side perspective view of an athletic shoe inner sole according to the present invention.

FIG. 4 illustrates an important component of the foot comfort and support system of the present invention. Many athletes have problems with falling arches, athlete's foot, turf toe and other uncomfortable foot conditions. To alleviate such problems, a special removable insole 50 is provided. This insole has an upper layer 52 that has at least a toe portion 54 and a heel portion 56 made of a porous, spongy material that is capable of absorbing moisture to keep these parts of the feet dry. Alternatively, the entire upper layer 52 can be formed of this type of spongy material. In addition to keeping the feet dry, this material helps to eliminate friction.

Comfort may also be enhanced by providing a series of recesses or depressions 55 in the toe portion 54 of the upper layer 52 of the insole that correspond substantially to the profile of the toes. This also keeps the toes from sliding into the front of the shoe, which causes turf toe. Some protection for toes that have been stepped on is additionally provided by this arrangement.

Below the insole spongy layer 52 is a sheet of material 58 which is preferably a soft thin plastic. Between this material 58 and another sheet of a sturdier plastic 59 is a cushioning layer of air 60. This bottom layer of air greatly increases the comfort of the present athletic shoe by relieving pressure on the bottom of the feet. In approximately the center of the air layer positioned to correspond to the location of the wearer's arch is an air-filled arch support 62. The air-filled arch support prevents falling arches and the pain associated with this condition.

Figure 5:
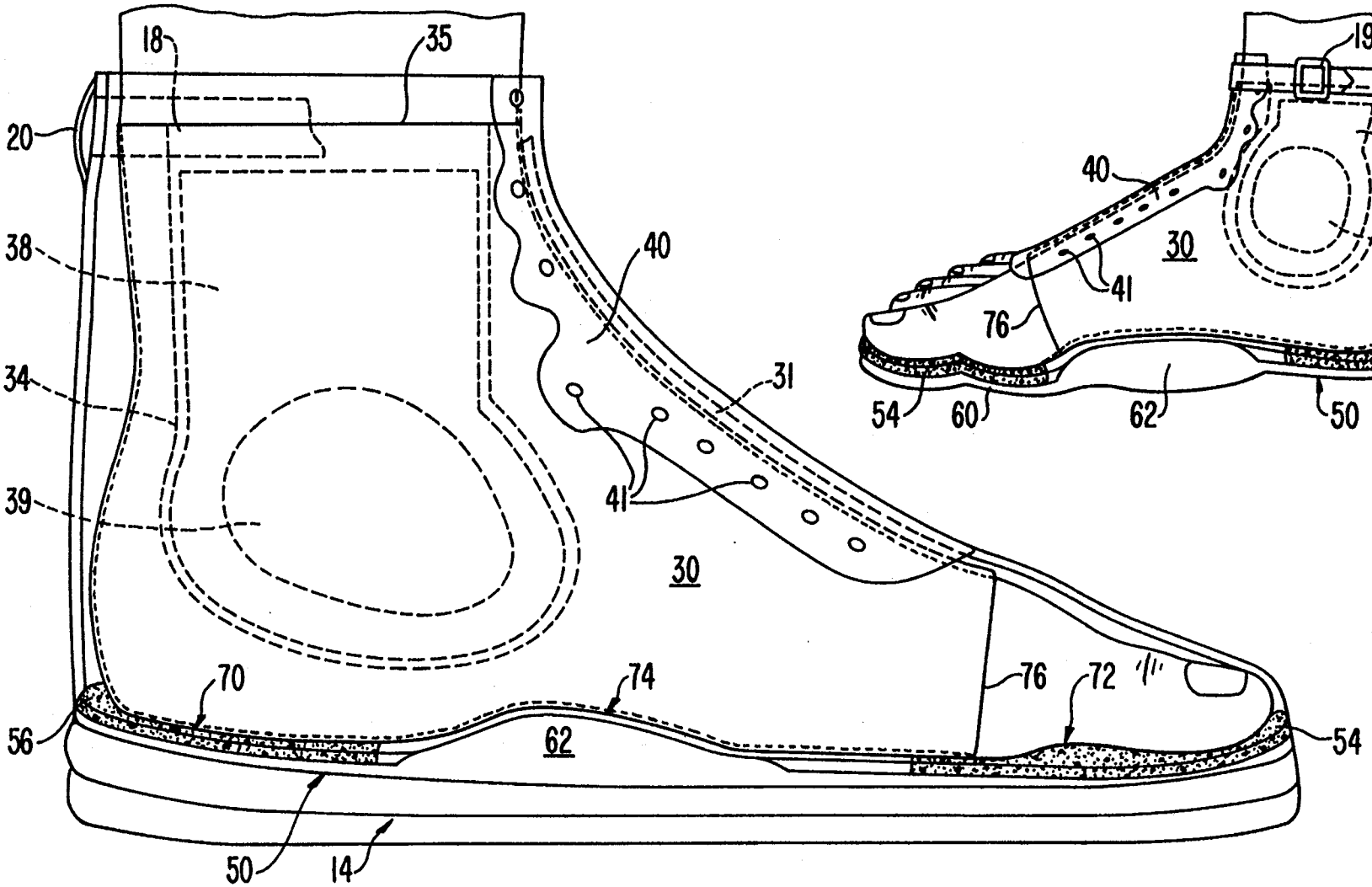
FIG. 5 is a diagrammatic side view of an athletic shoe according to the present invention showing the location of the ankle support system and the foot comfort and support system relative to the wearer's foot.

FIG. 5 is a diagrammatic illustration of the medial side of the left foot and ankle of a wearer in the athletic shoe of the present invention and illustrates the position of the wearer's foot and ankle within the shoe and the relative locations of the ankle support system and the foot comfort and support system. The air pockets 24, 26 and 28 (FIGS. 1, 2 and 3) are not shown. The insole 50 of FIG. 4 is positioned inside the shoe above the outer sole 14. In this insole embodiment, the heel area 70 and the area around the toe and the ball of the foot 72 contact the spongy surfaces 54 and 56 of the insole 50. The arch 74 of the foot is supported by the insole air cushion arch support 62.

When the wearer puts the shoe on his or her foot, the foot is inserted into the sock-like brace 30. The brace 30, which is preferably attached to the tongue 31, is shown to extend over the foot to approximately the ball of the foot, terminating at 76. However, the brace could cover the entire foot, including the toes, if desired. The location of the terminating edge 76 of the brace 30 should be chosen to minimize irritation to the portion of the foot under the terminating edge, since the brace should, ideally, fit snugly to provide optimum support.

One of the pockets 34, which is on the interior surface of the brace 30 for holding an ankle support insert 38 is shown in dashed outline in FIG. 5. The ankle support insert 38 is shaped specifically to fit the ankle area around the medial malleolus (ankle bone) of the left foot. A slightly different shape is required for the ankle support insert (not shown) that is positioned over the lateral malleolus on the other side of the left foot. Similar differences in the configurations of the lateral and medial ankle supports are necessary for the right foot. The ankle support insert cut-out portion 39 prevents irritation to the ankle bone while providing support and allowing movement of the ankle joint. The pocket 34 has a complimentary configuration to that of the ankle support insert 38 and is sized to be only slightly larger than the ankle support insert to permit insertion and removal of the ankle support insert. Once inserted in the pocket 34, the ankle support insert 38 should be held in the desired position so that the cut-out portion 39 encircles the ankle bone. The ankle support insert 38 terminates short of the open edge 35 of the pocket 34 and below, the strap 18 when it has been secured in place around the ankle outside the shoe upper 12. This arrangement tightens the top of the brace 30 and keeps the ankle support insert from sliding toward the top of the shoe and out of place.

FIG. 5 also shows the air-filled strip 40 that cushions and supports the top of the foot in the area of the lace holes or eyelets 41 when the shoe is tightly laced.

Figure 6:
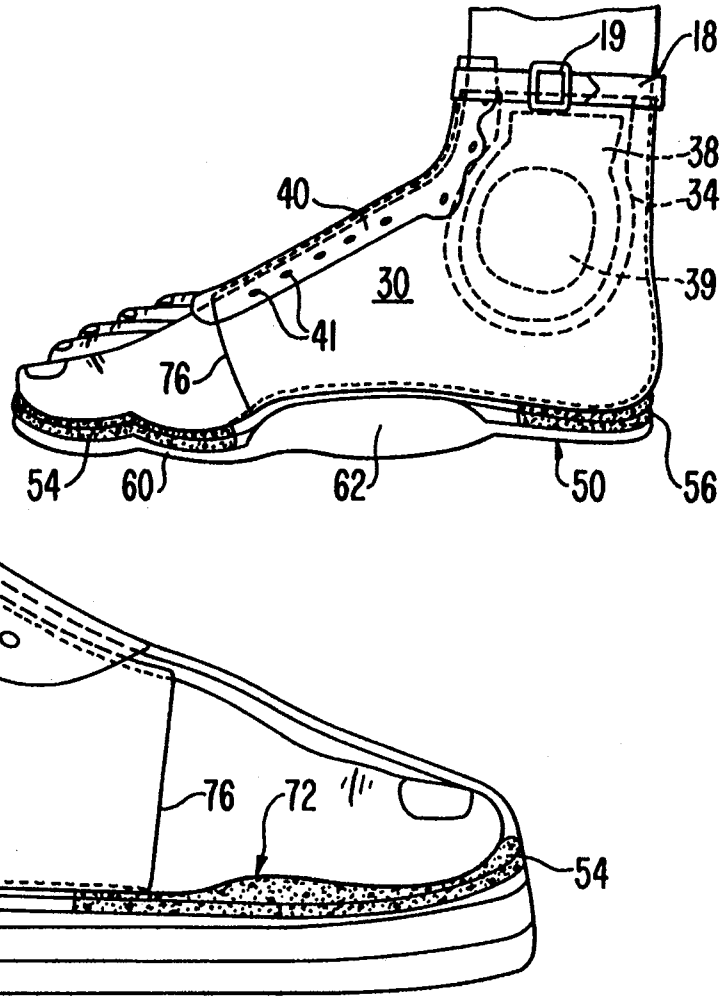
FIG. 6 is a diagrammatic side view of a wearer's foot illustrating the positions of the support structures of the present invention on the foot.

FIG. 6 illustrates diagrammatically all of the components of the ankle support and foot comfort and support systems of the present invention apart from the shoe in relation to the right foot of a wearer, viewed from the medial side of the right foot and ankle. The insole 50 is shown as it would appear if the wearer was standing up and putting his or her full weight on the insole. The front portion 54 under the toes and ball of the foot is able to conform comfortably to the shapes of these structures because of the air layer 60 in the insole.

The wearer's foot is shown in the brace 30, and the flexible ankle support insert 38 is in place in pocket 34 so that the cut-out portion 39 encircles the medial malleolus of the right foot. The strap 18 is shown buckled in place around the top of the brace. The air-filled cushion 40 cradles and supports the top of the foot.

The athletic shoe of the present invention is designed to provide comfort and support to the foot and ankle while reducing the overall shoe weight. This lightweight athletic shoe can be used by athletes in many different sports simply by varying the design of the outer sole 14 to provide the type of shoe bottom surface required for the sport or activity.

Industrial Applicability

The foot and ankle-supporting lightweight athletic shoe of the present invention will find its primary applicability as a basketball shoe. However, the ankle support system and foot comfort and support systems incorporated into this shoe design can be used for shoes for a variety of other sports and activities from hiking to tennis to aerobics. The support systems incorporated into this shoe design could also be used in rehabilitation shoes to be worn by those who are recovering from ankle or foot injuries or ankle or foot weakness caused by neuro-muscular disorders such as strokes, cerebral palsy and the like.

I claim:

1. A lightweight athletic shoe which includes cooperative foot and ankle support systems that may be adjusted or activated as needed to support an athlete's foot in a manner which substantially minimizes or prevents foot and ankle problems encountered as a result of subjecting a foot and ankle to intense athletic activity at frequent intervals, said athletic shoe comprising:

(a) an upper with a top edge that extends above an ankle made of a flexible, supportive lightweight material with a number of air-filled pockets selectively positioned in the upper material and including an opening over the top surface of a foot with a tongue disposed therein;

(b) a sole attached to a bottom edge of the upper;

(c) an ankle support system adjustable to provide a variable degree of medial and lateral support to the athlete's ankle including a brace attached to the upper to substantially cover a foot, wherein said brace includes a pair of pockets positioned to cover the lateral and medial portions of an ankle when the brace is on a foot, each said pocket configured to removably receive and hold in an optimum ankle supporting position a removable medial and a removable lateral flexible ankle support element, said ankle support system further including an adjustable ankle strap removably positioned adjacent to the top edge of the upper over an ankle; and (d) a foot comfort and support system including an insole positioned between the sole and the brace adjacent to the bottom of the athlete's foot and an air-filled cushion positioned in the upper adjacent to and circumscribing the opening, wherein shoe lace-receiving holes are positioned in said air cushion.

2. The lightweight athletic shoe described in claim 1, wherein said brace is attached to said tongue.

3. The lightweight athletic shoe described in claim 2, wherein each said removable ankle support element comprises a flexible plastic element with an opening configured to correspond generally to the location of a malleolus on a wearer's foot, and said lateral ankle support element is configured to support a lateral surface of an ankle without contacting a lateral malleolus and said medial ankle support element is configured to support a medial surface of an ankle without contacting a medial malleolus.

4. The lightweight athletic shoe described in claim 3, wherein said removable ankle support element includes an opening positioned in said support element to circumscribe the malleolus so that the malleolus protrudes through the opening.

5. The lightweight athletic shoe described in claim 3, wherein said lateral pocket is complimentarily configured to hold said lateral ankle support element securely in place and said medial pocket is complimentarily configured to hold said medial ankle support element securely in place.

6. The lightweight athletic shoe described in claim 5, wherein said ankle strap includes a buckle for securing said ankle strap in position about the upper and said upper includes a strap holder to removably attach said strap in the required location.

7. The lightweight athletic shoe described in claim 1, wherein said insole comprises a foot-engaging layer and an air-filled cushion layer adjacent to said foot-engaging layer, wherein at least a portion of said foot-engaging layer is formed of a porous, spongy material that absorbs moisture and said air-filled cushion layer includes an air-filled arch support cushion positioned to contact and support an arch of a foot when a foot contacts the foot-engaging layer.

8. The lightweight athletic shoe described in claim 7, wherein said insole is generally shaped to conform to the contour of the bottom of a foot.

9. The lightweight athletic shoe described in claim 8, wherein said foot-engaging layer includes a recessed area generally configured and positioned to correspond to the shape and location of toes of a foot.

10. The lightweight athletic shoe described in claim 1, wherein said brace is made of leather or a synthetic leather and said ankle support elements are made of flexible plastic.

11. The lightweight athletic shoe described in claim 10, wherein the brace covers a foot from the base of the toes to the top edge of the upper.

12. The lightweight athletic shoe described in claim 10, wherein the brace covers on entire foot.

13. The lightweight athletic shoe described in claim 1, wherein only one removable ankle support element is received in one of said pair of pockets selected to provide optimum ankle support.

14. The lightweight athletic shoe described in claim 1, wherein said upper includes at least a pair of air-filled pockets located over a wearer's toes and an air-filled pocket located near a wearer's heel.

15. A lightweight basketball shoe which includes cooperative foot and ankle support and comfort systems that protect and support a wearer's foot in a manner which substantially minimizes or prevents foot and ankle problems encountered as a result of subjecting feet and ankles to the intense athletic activity at frequent intervals characteristic of basketball, said shoe comprising:

(a) an upper with a terminal edge that extends above an ankle made of a flexible, supportive lightweight material with a number of air-filled pockets selectively positioned in the upper material and including an opening over the top surface of a foot extending from the base of the toes to the terminal edge with a tongue disposed therein;

(b) a sole attached to a bottom edge of the upper;

(c) an ankle support system adjustable to provide a variable degree of medial and lateral support to an athlete's ankle including a brace attached to the upper which is configured to cover a foot from the ankle to the toes, wherein said brace includes a pair of pockets positioned to cover the lateral and medial portions of an ankle when the brace is on a foot, each said pocket being configured to removably receive and hold in an optimum ankle supporting position a removable medial and a removable lateral flexible ankle support element, said ankle support system further including an adjustable ankle strap removably positioned adjacent to the terminal edge of the upper over an ankle; and (d) a foot comfort and support system including a layered insole positioned between the sole and the brace to contact the bottom of the brace and an athlete's foot and an air-filled cushion positioned in the upper adjacent to and circumscribing the opening, wherein the insole is configured to conform generally to the contour of the bottom of a foot and includes a moisture-absorbing upper layer with a recessed area configured and positioned to correspond generally to the shape and location of the toes and an air cushion layer with an air-filled arch support cushion layer positioned to contact an arch of a foot, and wherein the air-filled upper cushion includes a plurality of paired eyelets spaced at intervals at each side of the opening to receive a length of shoe lace.

* * * * *